US005119422A

United States Patent [19]

Price

[11] Patent Number: 5,119,422

[45] Date of Patent: Jun. 2, 1992

[54] OPTIMAL SONIC SEPARATOR AND MULTI-CHANNEL FORWARD IMAGING SYSTEM

[76] Inventor: David A. Price, 25145 Manzanita Dr., Dana Point, Calif. 92629

[21] Appl. No.: 591,130

[22] Filed: Oct. 1, 1990

[51] Int. Cl.[5] ..... H04R 5/02

[52] U.S. Cl. ..... 381/24

[58] Field of Search ..... 381/1, 17, 24

[56] References Cited

U.S. PATENT DOCUMENTS

| | | | |
|---|---|---|---|
| 3,757,046 | 9/1973 | Williams | 381/24 |
| 4,048,442 | 9/1977 | Mannila et al. | 381/1 |
| 4,382,157 | 5/1983 | Wert, Jr. | 381/24 |
| 4,399,328 | 8/1983 | Franssen et al. | 381/1 |
| 4,888,809 | 12/1989 | Knibbeler | 381/24 |

*Primary Examiner*—Forester W. Isen
*Attorney, Agent, or Firm*—Robert R. Meads

[57] ABSTRACT

A method and system for separating and "unmixing" prerecorded and mixed right and left stereo sound input signals into three (3) or more output sound signals for sound reproduction by three or more loudspeakers spaced apart and located forward of a listener or listeners. The output sound signals are linear combinations of the right and left sound input signals and uniquely satisfy conditions of sound linearity, symmetry, uniformity, normality, integrity, balance, constancy, and fidelity to create a substantially more accurate sound image of the recorded performance than that created by reproducing only the stereophonic sound input signals.

21 Claims, 18 Drawing Sheets

OPTIMAL SONIC SEPARATOR AND MULTI-CHANNEL FORWARD IMAGING SYSTEM

BACKGROUND

1. Field of the Invention

This invention relates to sound signal processing and reproduction, specifically to reproduction of a sound image using 3 or more loudspeakers, spaced apart and placed forward of the listener, to independently produce sounds separated from a stereo (2-channel) source according to the relative locations of the sound sources in the stereo mix.

2. Description of the Prior Art.

I am not aware of any patents in the field of sonic separation into more than 3 forward channels. The more broadly related fields of stereo imaging, triphonic, quadraphonic, and surround sound are therefore reviewed. FIGS. 1A through 1D illustrate the relative loudspeaker and listener locations used with such sound reproduction systems. In these Figures, the names of inventors mentioned herein with respect to such systems ar found on the associated diagrams.

Since the beginning of sound reproduction, inventors and engineers have attempted to make reproduced sound as similar as possible to its original source sound. Continued improvements in the state of the art have come about in many areas. Various types of distortion have been reduced. Frequency response has been made both broader and flatter. Unwanted noise has been greatly reduced. Various signal recording systems have been developed, including records, tapes, and optical discs. Monophonic sound reproduction has advanced to where a single loudspeaker in an anechoic room can be made to sound almost indistinguishable from a single instrument or vocal sound source.

The reproduction of multiple sound sources, however, has been less successful. It was recognized early that 2 loudspeakers, each with its own signal, could create a better sound image than could a single loudspeaker. It was also shown by Clark, Dutton, and Vanderlyn in their article, "The 'Stereosonic' Recording and Reproducing System," in the Jul.-Aug., 1957 issue of the IRE Transactions on Audio, that if sounds were properly recorded, and the listener properly located relative to the loudspeakers, then the location of the original sounds could be approximated by an apparent or virtual image between the loudspeakers within a limited frequency range. The preferred listener location is equidistant from both loudspeakers, at a distance greater than the distance between the speakers.

There has been a great deal of research done on human hearing, acoustics in general, and psychoacoustics in particular, to better understand how sound localization takes place. An example of this research applied to audio imaging is found in an article by Bauer titled "Phasor Analysis of Some Stereophonic Phenomena," published in the Nov., 1961 issue of The Journal of the Acoustical Society of America. Bauer and other inventors have used this research to improve and expand the virtual image. This image, however, is different from the true image. The difference is in the reproduced sound field. In a live music performance, the various sounds come from many different locations in front of the listener. The locations of these sound sources can be heard from any listener location. When music is recorded in stereo, the sounds from all sources are mixed into only 2 channels, left and right. This is done in such a way that sounds from the left are heard more loudly from the left loudspeaker and sounds from the right are heard more loudly from the right loudspeaker. Sounds from the middle are mixed more equally into both channels. Research has shown that at the correct listener location, the sound pressures at the ears of the listener can be made to approximate the corresponding pressures at a live performance, thus creating a good virtual image. Unfortunately, the stereo sound field approximates the live sound field only at that location. That is where the listener must be to hear the virtual image correctly.

Due to the phasor nature of the virtual image, it is also unstable with respect to both motion and attitude (direction) of the listener. That is, if the listener either moves from side to side or turns the head away from pointing directly forward, the virtual image will also move. This, of course is not true of the real image observed in a live performance. In fact, motion of the head is normally used by the brain to pinpoint the location of sound sources and distinguish them from their echoes in an echo rich environment.

Another disadvantage of 2-loudspeaker systems is that when loudspeakers are placed more than about 30 degrees apart, as viewed by the listener, the virtual image between them is weakened. The result is that if the loudspeakers are spaced far enough apart to include the breadth of live sound sources, such as an orchestra which may span 90 degrees, then there is a significant hole in the middle from which very little sound seems to come. Even sounds which are mixed equally into both left and right channels seem to come from the 2 separate loudspeakers thus spaced and not from between them.

For these reasons, stereo systems only image well when the listener is motionless, facing directly forward on the centerline between the loudspeakers, and at a sufficient distance from the loudspeakers. A further disadvantage of these constraints is that stereo systems do not fit well into most listening rooms. See FIG. 1A. To avoid early reflections from walls that will obscure the weak virtual image, both the loudspeakers 21 and 22 and the listener 20 must be placed away from the walls. This means that the loudspeakers and listener must be located near the middle of the room. In addition, to produce a good virtual image, the loudspeakers need to be at least 10 feet away from the listener and about half that distance apart. For best performance in a rectangular room 23 of normal proportions, the 2 loudspeakers must be located across a narrow end of the room, several feet from all walls, and the listener located at the other narrow end, several feet from the back wall. With these constraints, it is often impossible to achieve proper spacing. Movement through the listening room, which is often a living room, is made more difficult by the centrally located furniture. In general, then, the acoustical requirements for good stereo reproduction do not match the usual living requirements for the same room.

Various attempts at improving the stereo image have been made. Systems have been designed to reflect sound off walls to broaden and fill in the virtual image. Other systems that add phase shifted left and right signals to the opposite channels to cancel acoustic crosstalk at the listener's ears have been built and successfully marketed. Such systems often improve the image for the properly placed listener in the right acoustic environment, but are sometimes even more sensitive to listener placement than is regular stereo.

One more problem with stereo sound is that a great deal of th original ambient sound is obscured in the reproduction process. This seems to be a result of the weakness of the virtual image and its confinement to the region between the loudspeakers. Sound reflections from the listening room easily overpower the weak virtual image of reflected sounds from the original environment. A large and profitable industry has been built around devices to generate artificial ambience for both recording and reproduction of sound. These range from spring type reverberators to digital processing simulators of the measured echo environment of specific concert halls.

In spite of all its shortcomings, stereo (2-channel) recording has become the industry standard. Even with such sweeping changes in the audio industry as the development of compact discs and high speed digital signal processing, stereo recordings remain the standard.

Various advancements have been made in the area of quadraphonic sound. See FIG. 1C. The quadraphonic system uses 4 loudspeakers 30, 31, 32, and 33 arranged in a square around the listener 29 to create the illusion of the listener being completely surrounded b sound. The sounds thus reproduced seem to come from many directions. The effect of discrete quadraphonic sound can be a pleasant and startling one, but does not accurately represent what is heard at a live concert, where the sounds originate from the stage and orchestra pit in front of the listener.

In 1976, Willcocks disclosed, in U.S. Pat. No. 3,944,735, a system for decoding 4 sound channels recorded onto 2 channels using various types of encoding. His invention works well for quadraphonically encoded sources; but such recordings are rare since stereo recording is the standard. Stereo mixed recordings were never intended for reproduction through 4 loudspeakers surrounding a listener. Rather, the sounds thus mixed were intended to be heard from 2 loudspeakers located in front of the listener to simulate the location of the original performers. Herein Willcocks' and various other subsequent quadraphonic systems such as those disclosed by Cooper (1979) in U.S. Pat. No. 4,149,031, and Christensen (1982) in U.S. Pat. No. 4,316,058, all fall short. They may decode encoded signals, but they were never intended to separate sounds from stereo mixed recordings or improve the forward image.

Listener location requirements are more stringent for quadraphonic sound than for stereo. The listener must be equidistant from all 4 loudspeakers which must be at the 4 corners of a square. For this reason, quadraphonic systems have room fitting problems as great as those for stereo systems. Most listening rooms 34 are neither square nor large enough to provide sufficient spacing between the loudspeakers and the listener. With either quadraphonic or stereo sound, 2 people cannot enjoy the same sound image together because listener placement is so critical.

In 1978, Doi and Wakabayashi disclosed, in their U.S. Pat. No. 4,069,394, a device for improving the stereo image using only 2 loudspeakers. Their FIGS. 6 and 8 show circuits which could, if used properly, perform some functions similar to some of those of my invention. Their FIG. 6 is a circuit diagram of a pair of voltage dividers. Their FIG. 8 is a circuit diagram of two differential amplifiers connected in parallel. These simple circuits, however, are not unique to their design or to mine and can be found in many texts on basic electronics such as Walter G. Jung's "Audio IC Op-Amp Applications," first published in 1975 by Howard W. Sams & Company. My invention and many others make use of similar voltage differencing circuitry.

The stated object of Doi et al in using the circuitry of their FIGS. 6 and 8 is to produce from left and right inputs (L and R), outputs equivalent to L-ΔR and R-ΔL, where Δ is a fraction of 1. They specifically state that for "The circuits shown in FIGS. 6 and 8 . . . the quality of the sound image provided thereby is the same as that provided by an ordinary 2-channel stereophonic system." The inadequacy of these embodiments results from Doi et al's failure to recognize and satisfy the conditions of optimality which I define hereinafter relative to my invention.

Other embodiments of Doi et al's invention are frequency dependent and employ both filters and phase compensation. These are required to compensate for frequency dependency of the virtual image as noted by Clark et al. Further, with the Doi et al invention, listener location is a critical as with regular stereo.

A similar system to that of Doi et al was disclosed in 1980 by Kogure et al in U.S. Pat. No. 4,219,696. Their device attempts to simulate the sound of a quadraphonic system using only 2 front loudspeakers. This would seem to have little value for music reproduction, since 2 front loudspeakers naturally produce a virtual image of a music performance that is as accurate as that of a quadraphonic system. Their invention does not attempt to separate mixed forward sounds by location. In addition, since only 2 loudspeakers are used to simulate 4, it is more sensitive to listener location than a similar quadraphonic system would be.

In 1985 Watanabe disclosed, in U.S. Pat. No. 4,524,451, a device for manually positioning single or multiple monophonic sound sources between many loudspeakers surrounding a listener. If all the original sound sources were available on separate channels, his device, if properly adjusted manually, would reproduce them very well. It does not, however, separate those sound sources out of 2 stereo channels once they are mixed.

Various surround sound systems have been developed and used primarily to improve the sound of movies. See FIG. 1D. Many movie sound tracks are encoded into left 37 and right 39 channels. Sounds to be heard from the screen are encoded by recording them in phase in both channels. Sounds intended to come from behind the audience are encoded by recording them out of phase in the left and right channels. Surround sound decoders create a synthesized center channel 38 by adding the left and right signals. The derived center channel places all in-phase sounds near the center of the screen. Rear or "surround" channels 36 and 40 are decoded by differencing the left and right signals In 1986, Blackmer and Townsend disclosed, in their U.S. Pat. No. 4,589,129, a device for reproducing surround sound from encoded 2 channel recordings. Their system produces L, R, L+R, and L−R output signals, with various amplitude, phase, and frequency adjustments. It is very effective for movie sound tracks which have been encoded to simulate everyday sounds coming from all directions. But as with quadraphonic sound, surround sound does not accurately represent what is heard at a live music performance. Music is generally not intended to surround a listener 35, but to come from in front of the listener. Systems such as theirs, which use only whole combinations of left and right signals, lack the subtlety of imagery needed for accurate music reproduction. The surround sound listening room 41 must be rather large to provide sufficient distance between the loudspeakers and listener.

The result of all virtual image systems, whether stereo or quadraphonic is that they produce a rather poor forward image. This is the major difference between live and reproduced sound. See FIG. 1B. Several triphonic systems have been developed to improve the forward image by adding a synthesized center channel 26 similar to that used in surround sound systems. Adequate listening room 28 spacing is often possible with such a system because a true central image is less vulnerable to wall reflections than is a virtual image.

In 1986 Rosen disclosed, in his U.S. Pat. No. 4,594,730, a device for producing a center channel from the left and right stereo channels. His center channel is used to reproduce "direct" or monaural sounds, while the other 2 channels 25 and 27 reproduce "indirect" or ambient sounds. Such separation of "direct" and "indirect" sounds is accomplished by subtracting the signal generated for the center channel from both the left and right channels. Because the center channel is frequency band limited, however, the cancellation and resultant separation is not complete. Such frequency dependency is a very undesirable characteristic for a separation device. This is especially true for a center channel which is supposed to reproduce "direct" sounds. A listener 24 should hear the full spectrum of sound for each instrument or voice independent of its location. A greater problem with his approach is that, in fact, all original sound sources are "direct" and monaural, yet they come from many locations in a live performance, not just from the center. Even in a stereo recording, a monaural source can be recorded entirely in either the left or right channel. "Direct" does not mean directly in front.

Still another weakness of the Rosen invention is its use of variable resistances, so that the listener can control the image. His is the wrong approach if accurate sonic separation and sound field reproduction are the goals; because at a live performance, the image is not listener controlled.

Rosen also disclosed two 4-channel embodiments of his invention. In one of these, 2 loudspeakers are sent time delayed signals to enhance the ambient sound. This does nothing, however, to either separate the forward sounds or improve the image. The other 4-channel embodiment uses forward loudspeakers of which he states, "Acoustical center channel mixing is achieved when each individual channel of the 2 channel stereophonic source is fed to its own individual reproducer (therefore requiring at least 2 such reproducers) and when these reproducers are separated by a distance that is small when compared to the distance from the reproducers to a preferred listening location." His goal is clearly to emulate a 3 channel system by acoustical mixing, not to separate the sounds into more than 3 channels.

Latshaw, in his 1987 U.S. Pat. No. 4,685,136, disclosed an invention that uses 3 or 4 forward loudspeakers. He states that when 4 loudspeakers are used, "The first center speaker and the second center speaker are located at the center of the front of the room as closely together as practical, so that as a close approximation, the acoustical power of the speakers is perceived as coming from substantially the same location." Like Rosen, Latshaw's goal is to emulate a 3 channel system by acoustical mixing. This again is contrary to the concept of sonic separation in which the loudspeakers are spread out to avoid mixing sounds and to enhance separation.

Latshaw's device computes a time varying "commonality index" based on left and right time averaged signal envelopes. This is used to determine the mixture of left and right inputs in each of the output channels. Thus the image created by his device is both time varying and program dependent. His device also employs many directionality tests based on left and right signal envelope strength. These tests control switches in the signal processing path. Not only does his processing change with time due to the varying commonality index, but it changes discontinuously due to switching. The result is that sounds of lesser volume fail to hold their locations in the presence of louder sounds. That is, all sounds are erroneously steered in the direction of the loudest sounds. Even the louder sounds jump around as the various switching thresholds are crossed. In addition, the automatic balance feature of his design means that there is no true left or right locations, but all locations are relative to the momentary center or average between left and right. His invention is yet another example of a frequency dependent device which is not optimal for musical sound reproduction In 1988, Tofte disclosed in his U.S. Pat. No. 4,747,142, another device for generating a center channel and modified left and right channels. His is the only device of which I am aware that purports to approach the sonic separation problem. Tofte says that his invention "could be likened to a reversal of the studio's mixdown process, where many separate microphone signals are 'panned' onto a final master tape through a mixing console equipped with individual balance controls for changing the apparent position of each microphone in the stereo image." His device uses logarithmic compression and expansion. Between the compression and expansion, frequency band limited signals from the left and right channels are added together. In addition to the deleterious effects of filtering, the effect of this log-add-antilog process is that the output contains a product, instead of a sum, of left and right signals. This nonlinearity enhances separation, but greatly increases distortion of the thus separated sounds. In addition, the sonic balance between loud and soft sounds is upset in the process. This results in a serious loss of realism for the listener.

The work of Rosen, Latshaw, and Tofte shows that imaging improvements are possible using triphonic systems that remove part of a frequency band limited derived center channel from the left and right channels. Such systems work adequately for spoken voices, but fail to reproduce the full audio frequency spectrum from all channels. This limits their effectiveness for reproducing musical sounds.

Because loudspeakers must be spaced no more than 30 degrees apart to maintain proper imaging between them, at least 4 loudspeakers are required to cover the full 90 degrees of the forward image. If fewer than 4 are used, then the breadth of the image must be reduced or the quality of the image between the loudspeakers is compromised.

None of the prior art known to me and described above teaches the separation into more than 3 channels of forward sounds mixed in stereo. Those who have mentioned more than 3 forward channels (Rosen and Latshaw) have done so with regard to acoustical mixing of right and left channels to produce a middle channel, not with regard to a 4, 5, 6, or more channel separation of sounds.

SUMMARY OF THE INVENTION

If stereo mixed sound signals could be "unmixed" or separated and sent to loudspeakers with relative locations similar to the relative locations of the original sound sources, then a very accurate, realistic sound image could be created. Since only 2 channels are recorded, however, a method is needed to separate the mixed signals into 3 or more channels in a way which accurately represents the locations of the sounds in the original mix. To date, this has not been attempted for more than 3 loudspeakers; and the 3 loudspeaker implementations have not been consistent with the principles governing such separation. These principles have heretofore not been collectively recognized and therefore not applied to the development of such systems. Though it is impossible to completely separate mixed sounds; it is possible to partially separate them in a best or optimal way so that a sonically convincing illusion of such separation is created.

My invention directly addresses and solves this separation and forward imaging problem. Insofar as possible, it separates the mixed sounds according to location and sends the separated signals to forward loudspeakers located near the relative locations of the original sound sources. This is done by summing and differencing fractions of the left and right signals in specific ratios for each channel which emphasize sounds from particular locations. Such fractional balancing produces a subtlety of imagery not possible using whole combinations.

More particularly, my invention comprises an improved forward sound imaging system including first and second inputs for receiving left and right channel audio input signals of a stereophonic system and n output channels for connection to n loudspeakers spaced symmetrically left to right and forward of a listener, where n is any whole number greater than two. Between the inputs and output channels are n independent means, each responsive to the left and right audio input signals for developing a first through n-th audio output signal representative of a sum of a product of a first through n-th coefficient and the left audio input signal and a product of the n-th through first coefficient and the right audio input signal, in the first through n-th output channel, respectively.

My invention reproduces each sound from a loudspeaker near the relative location of the original sound source. Thus, the image is realistic and convincing, and is less dependent on listener location than is a virtual image.

In inventing my above described optimal sonic separator, I observed where the prior art fell short and sought to understand what the prior art had failed to teach. I discovered principles and formulated conditions which I believe an optimal sonic separator must satisfy. A review of the prior art revealed that such conditions were not collectively stated elsewhere, and that several of them were not stated anywhere. The names given my formulated conditions are also original with this invention. That is to say, not only is this invention novel, but the recognition and naming of the principles upon which it is founded and their formulation into mathematical conditions, is original. The combination of all these conditions yields a unique solution to the sonic separation problem. My invention is optimal therefore, in that it is uniquely consistent with the following eight principles of sonic separation:

1. Linearity—To avoid signal distortion, the separation process must be linear with respect to voltage.

My invention avoids the problems associated with nonlinearity by using only linear combinations of the left and right input signals to produce all the separated output signals. The separation thus produced is sufficient to greatly enhance the image and sense of reality, and does not distort any of the individual sounds or disturb their relative volumes. Thus both low distortion and perfect sonic balance are preserved by my invention.

2. Symmetry—The entire separation process must be symmetric about the centerline between left and right.

3. Uniformity—The total output power for every input signal must be independent of its mixed location. In other words, the relative volumes of all sounds in the mix must remain unchanged by the separation process.

4. Normality—The total output power must be the same as the total input power. That is, the separation process must not change the total volume.

5. Integrity—The output from each channel must be greatest for signals mixed in the location of that channel's output.

If a loudspeaker could be placed at the same relative location as each original sound source and could reproduce only the sound from that source, then the original sound field could be accurately reproduced, and the listener location would be much less important. Each loudspeaker added to a stereo system, if it reproduces most loudly those sounds which originated at its relative location, will improve the accuracy of the sound field reproduced by the system.

6. Balance—The power output from each channel must be the same when averaged over all mix locations.

One of the problems observed with previous multiloudspeaker systems is that when loudspeakers are added between the left and right loudspeakers, the image seems to be pulled toward the middle. This is an undesirable effect if it narrows the image. On the other hand, if the addition of extra loudspeakers allows the total spread of the loudspeakers to be increased, a broader image can be realized. With my invention, 4 or more loudspeakers can be spread over a 90 degree angle to separate their individual sounds. For best separation, the loudspeakers are placed so that the distance between each adjacent pair is the same. If the output from each loudspeaker is balanced with the others, and they are evenly spaced, then the pull toward the middle exactly compensates for the hole in the middle described earlier that occurs when 2 loudspeakers are widely spaced. Thus a smooth and even distribution of sound is achieved. This effect can be seen in FIG. 4.

7. Constancy—The separation process must remain constant and be independent of input program material, so that the image neither changes continuously nor jumps discretely.

In my invention, optimal coefficients are chosen for the linear combinations of inputs based on acoustical and electronic principles. These coefficients do not depend on either time or program material.

8. Fidelity—The separation process must be independent of frequency within the audio band.

The problems of frequency dependent imaging which Clark, Doi, and others point out can be avoided by using more loudspeakers to restore the stereo image based only on instantaneous relative amplitude of the left and right inputs and not on frequency. It is extremely important that the separation process be independent of frequency so that maximum signal cancellation occurs for sounds mixed away from each loudspeaker's location. Each of the separated channels must reproduce the entire audio frequency spectrum without phase shifting relative to frequency or to the other channels. This precludes the use of filter circuitry in the design.

I have quantified these principles in terms of the relative location of mixed sounds between the left and right loudspeakers. This allowed me to formulate conditions and solve mathematical equations related to the location of sounds in the mix and their associated instantaneous relative voltages in the left and right input channels.

Unlike some of the other systems with more than 2 loudspeakers, mine does not increase "indirect" or ambient sound, but rather uses the added loudspeakers to more accurately locate the "direct" sounds. With separated sound, the presence of a true and not just a virtual image results in the natural ambience of the recorded hall being heard much more clearly. Much less ambiance recovery processing is required. The listening room sound reflections, though still present, become less important.

Placement of both the loudspeakers and the listeners becomes less critical as more loudspeakers are added. The loudspeakers and listeners can be placed much closer to the boarders of the room than with stereo. In fact, as in a live performance, some listening room reflections can actually aid in the localization of sounds. The loudspeakers can therefore be spaced along a long side of a rectangular room, with the listener located near the opposite wall. This arrangement is much more natural, and fits better into most living environments where audio systems are usually found. If the loudspeakers are slightly out of place, the effect on the sound image is minor, like that of shuffling chairs in the orchestra.

It is the nature of loudspeakers and amplifiers to produce more distortion at greater volume. Most modern amplifiers produce almost no audible distortion until the point of clipping is reached, whereupon the distortion is very great. Similarly, most loudspeakers produce much less distortion when the excursion of their diaphragms is limited to the region of greatest linearity. This is one of the reasons why bi-amplification produces superior sound quality. In a properly bi-amplified system, neither the loudspeakers nor the amplifiers are required to work outside their range of optimal performance. Similarly, when the various sounds are separated and more loudspeakers and amplifiers are used to reproduce these sounds, both clipping and loudspeaker distortion are reduced substantially. In addition, as each amplifier and loudspeaker reproduces the simpler waveforms associated with separated sounds, that is, the waveforms of fewer and more similar instruments, rather than the extremely complex waveforms of the entire orchestra combined, the sound and texture of each instrument is heard with greater clarity and definition. Thus the principles of fidelity an balance work together to produce superior sound.

The reproduction of deep bass generally requires a large bass speaker. When additional loudspeakers are used, the individual bass speakers need not be as large as for a regular stereo system. This is particularly true of the very low frequencies, because their long wavelengths reinforce for all loudspeakers placed within several feet of each other.

Further objects and advantages of my invention will become apparent from a consideration of the drawings and the following detailed description.

DETAILED DESCRIPTION OF THE INVENTION

Figure 1A:
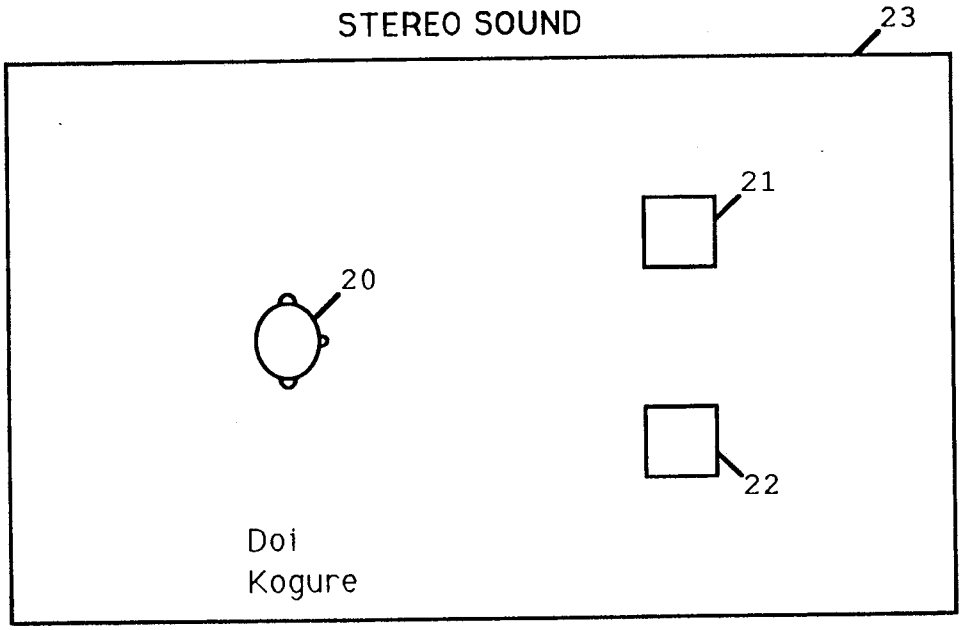
FIG. 1A shows the preferred relative loudspeaker and listener locations used with prior stereo sound systems.
Figure 1B:
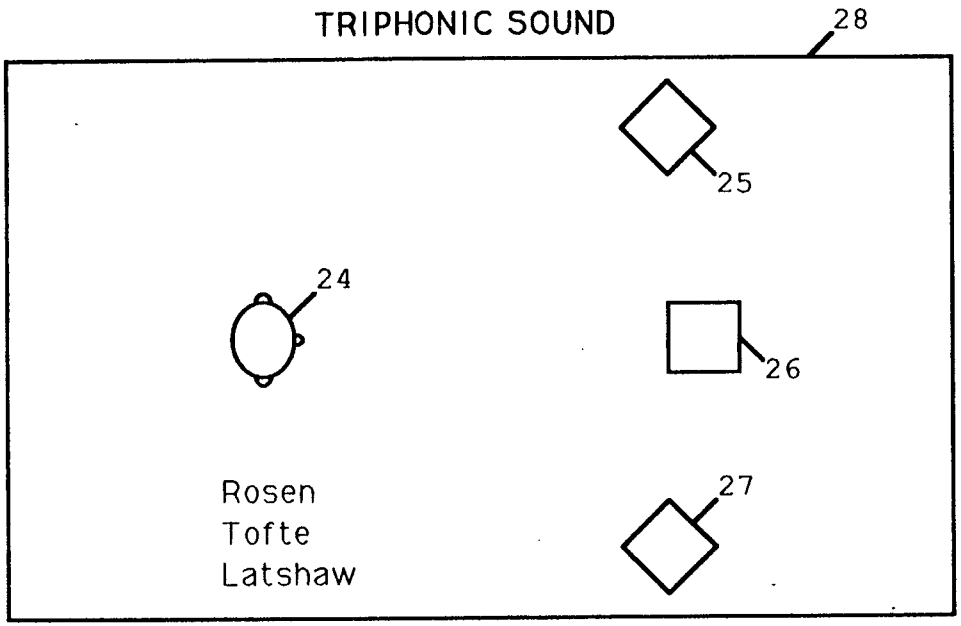
FIG. 1B shows the preferred relative loudspeaker and listener locations used with prior triphonic sound systems.
Figure 1C:
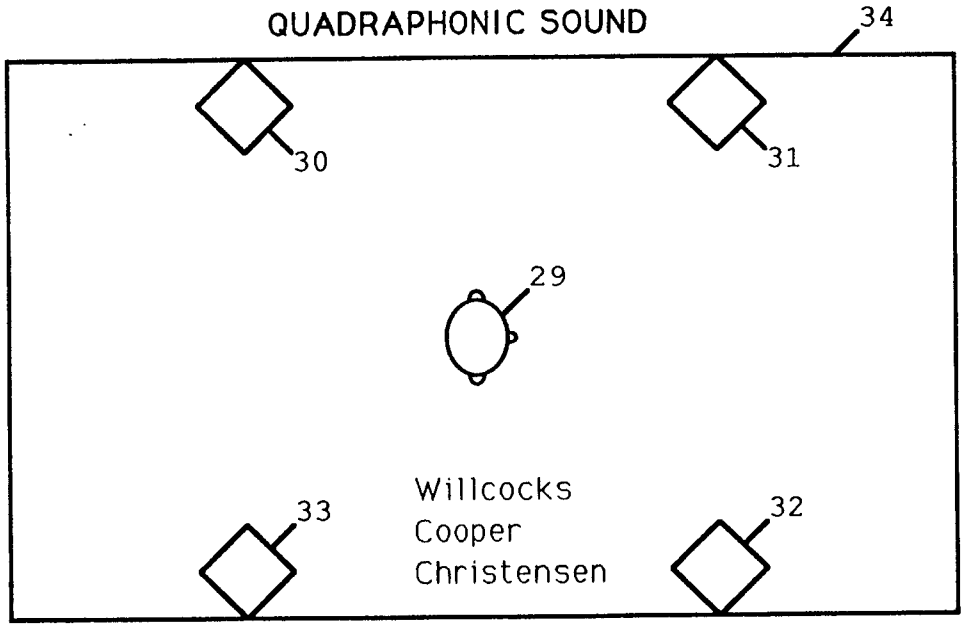
FIG. 1C shows the preferred relative loudspeaker and listener locations used with prior quadraphonic sound systems.
Figure 1D:
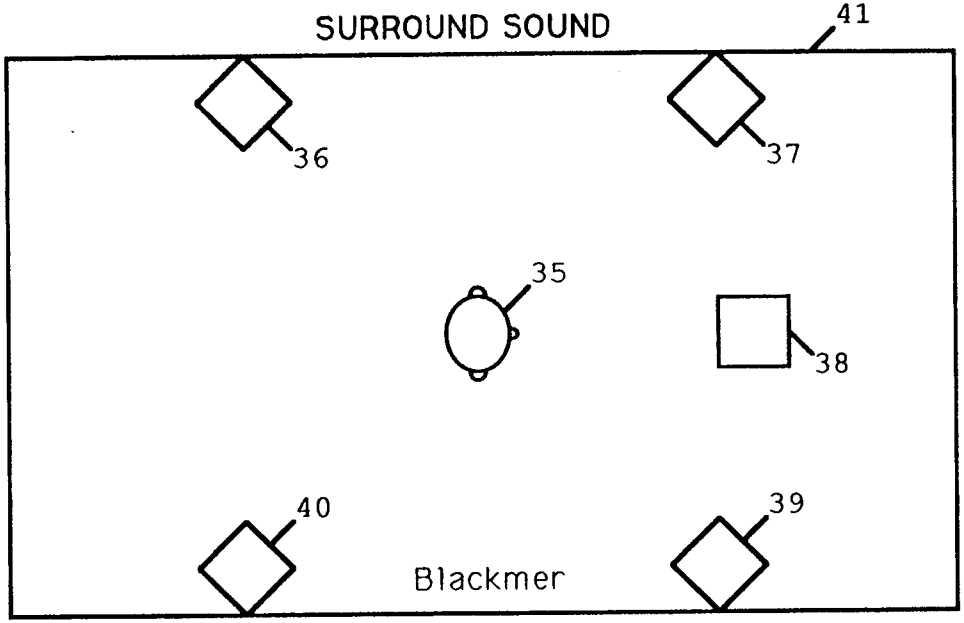
FIG. 1D shows the preferred relative loudspeaker and listener locations used with prior surround sound systems.

By using specific linear combinations of the left and right input signals, optimal output signals can be generated. Equations representing the interdependent conditions of optimality are developed and solved for the required linear coefficients. These conditions are sufficient to force a unique solution. The derivation of this solution follows; but first, some general definitions and concepts are presented.

All equations that are referenced elsewhere herein are numbered to the left of the indented equation.

Let n be the integer number of output channels in the separated mix (i.e. the number of loudspeakers to be used). $n>2$.

Let i be a whole number from 1 to n that indexes evenly distributed output channel locations sequentially from left to right.

Let x be a dimensionless real number between 0 and 1, inclusive, that represents the location of a signal in the mixed recording from left ($x=0$) through center ($x=\frac{1}{2}$) to right ($x=1$).

Let $y_i$ be a dimensionless real number representing the relative voltage of a signal in the i-th channel, defined as the ratio of the signal voltage in the i-th channel to the monophonic voltage of the same signal before mixing.

Since volume (power) is proportional to the square of voltage, $y_i^2$ is also a dimensionless real number which represents the relative power of a signal in the i-th channel, defined as the ratio of the signal power in the i-th channel to the monophonic power of the same signal before mixing.

Such voltage and power ratios can be expressed as functions of x. For example, when source sound signals are mixed into left (L) and right (R) signals during recording, industry standards require that the following 3 equations be satisfied:

$$L(x)=y(\text{left})=1$$

for $x=0$ $$R(x)=y(\text{right})=1$$

for $x=1$ $$L(x)^2+R(x)^2=1$$

for all x in [0,1]

This is done to make the volume independent of location (i.e. to provide uniformity) in the recording process. The relative volume from both loudspeakers of any sound thus recorded is 1 for all mixed locations. There are an infinite number of functions L and R of x which meet the above standards. Research has shown, however, that the following equations not only meet the standards, but closely approximate the relative voltages in the left and right channels for a sound source mixed at location x as perceived by a recording engineer located on the centerline between his 2 monitor loudspeakers.

$$L(x)=\cos(\pi x/2)$$

$$R(x)=\sin(\pi x/2)$$

where $\pi$ is the ratio of the circumference to the diameter of a circle, or approximately 3.141592654.

Figure 2:
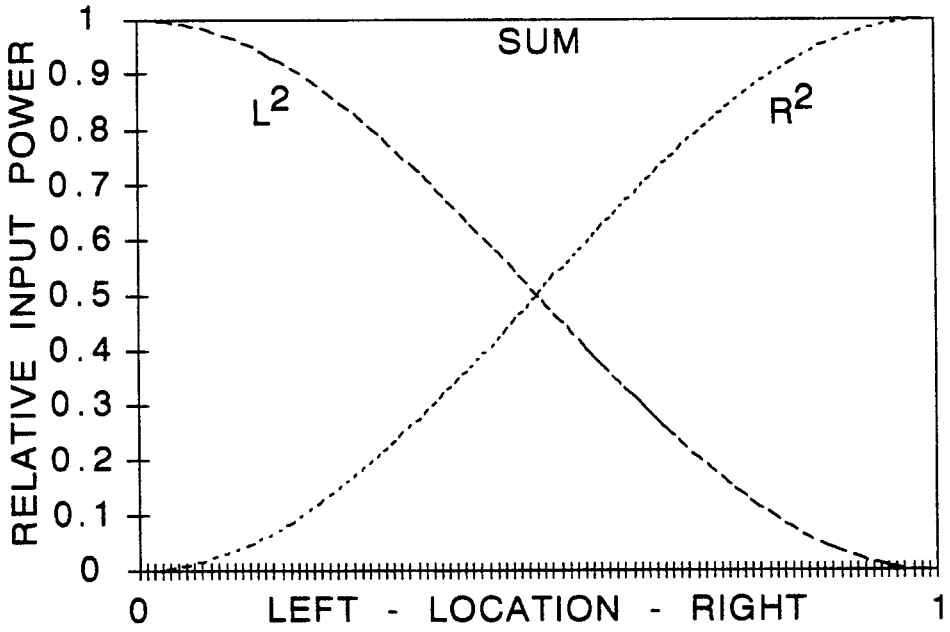
FIG. 2 shows the left and right relative input powers to my sonic separator as functions of mixed sound location. It also shows that their sum is always 1.

FIG. 2 shows the left and right relative input powers $L^2$ and $R^2$ as functions of x and also shows that their sum is always 1.

Let X be defined as the input column vector $(L,R)^T$, where the superscript T represents the transpose of a matrix or vector.

Let Y be defined as the column vector of relative output voltages $(y_1, y_2, \ldots, y_n)^T$.

1. Linearity—This condition can be stated in the following linear equation:

$$Y=MX \tag{1}$$

where M is an n-by-2 real-valued matrix of dimensionless coefficients.

2. Symmetry—This condition requires that the matrix coefficients to be multiplied by the left channel signal be the same as those for the right channel signal, but in reverse order. This can be stated mathematically as:

$$M=\begin{pmatrix} a_1 & a_n \\ a_2 & a_{n-1} \\ \cdot & \cdot \\ \cdot & \cdot \\ \cdot & \cdot \\ a_n & a_1 \end{pmatrix}=(A/A')$$

where $a_i$ are real numbers $A=(a_1, a_2, \ldots, a_n)^T$ $A'=(a_n, a_{n-1}, \ldots a_1)^T$ Note that symmetry as defined here for a nonsquare matrix differs from the usual term "symmetry," commonly defined with respect to a square matrix to mean "being symmetric about the principle diagonal." Note also that if n were equal to 2, then both symmetry definitions would be equivalent.

The equations for $y_i$ can now be written as:

$$y_i=a_iL(x)+a_{n-i+1}R(x)$$

for all $i=1,n$ $$y_i=a_i\cos(\pi x/2)+a_{n-i+1}\sin(\pi x/2)$$

for all $i=1, n$

3. Uniformity—Since the total output volume (power) is proportional to the sum of squares of all the output channel voltages, uniformity requires that the vector inner products $Y^TY$ and $X^TX$ be proportional, with the same constant of proportionality for all x in [0,1].

4. Normality—This condition further requires that the constant of proportionality above be 1. That is, $$Y^TY=X^TX \tag{3}$$

for all x in [0,1].

Thus Y and X have equal Euclidean length, 1, and are unit vectors in Euclidean n-space and 2-space, respectively.

Substituting the linearity equation (1) into the above equation (3) yields $$(MX)^TMX=X^TX$$

$$X^T(M^TM)X=X^TX$$

$$X^T(M^TM-I)X=0$$

for all unit vectors X where I is the 2-by-2 identity matrix.

This equation must hold for all unit vectors X, therefore $$M^TM=I$$

But $M=(A|A')$, therefore $$M^T M = \begin{pmatrix} A^T A & A^T A' \\ A'^T A & A'^T A' \end{pmatrix} = I = \begin{pmatrix} 1 & 0 \\ 0 & 1 \end{pmatrix}$$

Now $A'^T A' = A^T A$ and $A'^T A = A^T A'$, therefore the above matrix equation reduces to the following vector equations:

$$A^T A = 1$$

(A is a unit vector)

$$A^T A' = 0$$

(A is perpendicular to A')

These can be further reduced to 2 scalar equations. More explicitly, the conditions for normality and uniformity can be restated as:

$$1 = \sum_{i=1}^{n} a_i^2 \text{ (normality)} \tag{4}$$

$$0 = \sum_{i=1}^{n} a_i a_{n-i+1} \text{ (uniformity)} \tag{5}$$

5. Integrity—This condition is satisfied for the inner channels (2 through n−1) by choosing the ratio of $a_{n-i+1}$ to $a_i$ in order to maximize $y_i$, hence $y_i^2$, for particular values of x. Examples of inner channel $y_i^2$ curves plotted as functions of x can be seen in curve 2 and 3 of FIG. 3. Curves 1 and 4 represent outer channels. For curve 2 of this Figure, $a_i$ has been set to 0.4916586598 and $a_{n-i+1}$ to 0.2838592596. The power peak for these coefficients is at $x=\frac{1}{3}$. For curve 3, $a_i$ has been set to 0.2838592596 and $a_{n-i+1}$ to 0.4916586598. The power peak for these coefficients is at $x=\frac{2}{3}$. To better understand this, recall from the symmetry equation (2) that $$y_i = a_i \cos(\pi x/2) + a_{n-i+1} \sin(\pi x/2)$$

for all i=2, n−1

This has a maximum when the partial derivative of $y_i$ with respect to x is 0. Differentiation yields $$0 = -\pi/2\, a_i \sin(\pi x/2) + \pi/2\, a_{n-i+1} \cos(\pi x/2)$$

for $0<x<1$ or, equivalently, $$a_{n-i+1}/a_i = \sin(\pi x/2)/\cos(\pi x/2) \tag{6}$$

$$= \tan(\pi x/2) \tag{7}$$

Since the locations of the n output channels are to be evenly distributed between x=0 and 1, the i-th output peak can be forced to occur exactly at the location of the i-th output channel by letting $$x = (i-1)/(n-1) \tag{8}$$

This condition, then, completely determines the ratio of $a_{n-i+1}$ to $a_i$. Let the corresponding coefficient ratios, $c_i$, be defined by the left side of equation (6).

Substituting the expression for x given in equation (8) into the integrity equation (7), results in $$c_i = \tan(\pi(i-1)/(n-1)/2) \tag{9}$$

for all i=2,n−1

Note that this ratio is positive for all i=2,n−1, and that $a_i$ is also positive for all inner channels, since otherwise, location shifting between corresponding (symmetric) left-side and right-side output channels would occur.

Similarly, since $a_1$, the linear coefficient for the left and right input channels, is used to produce the left-most and right-most output channels, respectively, $a_1$ must also be positive. In addition, $|a_1|>|a_n|$, since otherwise the integrity condition would be violated.

Substituting the above equation (9) into the equation for uniformity (5) results in $$0 = 2a_1 a_n + \sum_{i=2}^{n-1} c_i a_i^2 \tag{10}$$

This equation shows clearly that $a_n<0$ for $n>2$. Thus for $|a_1|>|a_n|$, the only reasonable case, $y_1^2$ has its maximum at x=0; and $y_n^2$ has its maximum at x=1, as desired.

The integrity condition is thus characterized for all output channels.

6. Balance—This condition is satisfied when the integral of relative power with respect to mixed sound location is the same for all channels. That is, $$\int_0^1 y_i^2\, dx = \int_0^1 y_j^2\, dx \text{ for all } i,j = 1,n$$

which is true if and only if $$\begin{aligned} n\int_0^1 y_i^2\, dx &= \sum_{j=1}^{n} \int_0^1 y_j^2\, dx && \text{for all } i = 1,n \\ &= \int_0^1 \sum_{j=1}^{n} y_j^2\, dx && \text{for all } i = 1,n \\ &= \int_0^1 dx && \text{for all } i = 1,n \\ n\int_0^1 y_i^2\, dx &= 1 && \text{for all } i = 1,n \\ 1/n &= \int_0^1 y_i^2\, dx && \text{for all } i = 1,n \end{aligned} \tag{11}$$

7. Constancy—This condition means that the processing used to separate the signals must not change with time or program material. One result of this is that no user variable elements are permitted in the design. In addition, the processing must remain independent of the input signals. That is, no program dependent factors can have an effect on the processing of the input signals. Mathematically, this is stated by saying that the matrix coefficients $a_i$ are constants for all i=1,n.

8. Fidelity—This condition means simply that the circuitry used to perform the separation processing must contain no frequency filters having a substantial effect within the audio spectrum. There are no equations associated with this condition.

With the optimality conditions thus defined, a unique solution can be found. All conditions are satisfied by solving their corresponding equations simultaneously for the matrix coefficients $a_i$, for all $i=1,n$. Using the definition of $c_i$, equation (6) can be rearranged as $$a_{n-i+1}=c_i a_i \tag{12}$$

for all $i=1,n$

For all the inner channels, equations (2) and (12) can be substituted into equation (11) to yield, $$1/n = \int_0^1 (a_i\cos(\pi x/2) + c_i a_i \sin(\pi x/2))^2\, dx$$

for all $i = 2,n-1$

Let $z=\pi x/2$; then $dz=\pi/2\ dx$, and $dx=2/\pi\ dz$. Equation (11) then becomes $$\begin{aligned}
1/n &= a_i^2 \int_0^{\pi/2} \cos^2(z)\ 2/\pi\ dz \\
&\quad + c_i^2 a_i^2 \int_0^{\pi/2} \sin^2(z)\ 2/\pi\ dz \\
&\quad + 2c_i a_i^2 \int_0^{\pi/2} \cos(z)\sin(z)\ 2/\pi\ dz \\
&\qquad \text{for all } i=2,n-1
\end{aligned}$$

$$\begin{aligned}
1/(n\, a_i^2) &= 2/\pi \int_0^{\pi/2} (1-\sin^2(z))\ dz \\
&\quad + 2/\pi\ c_i^2 \int_0^{\pi/2} \sin^2(z)\ dz \\
&\quad + 4/\pi\ c_i \int_0^{\pi/2} \sin(z)\cos(z)\ dz \\
&\qquad \text{for all } i=2,n-1 \\
&= 2/\pi \int_0^{\pi/2} dz + 2/\pi\ (c_i^2-1) \int_0^{\pi/2} \sin^2(z)\ dz \\
&\quad + 2/\pi\ c_i [\sin^2(z)]_0^{\pi/2} \quad \text{for all } i=2,n-1
\end{aligned}$$

$i = 2,n-1$ $$\begin{aligned}
1/(n\, a_i^2) &= 1 + 2/\pi\ (c_i^2 - 1)[z/2 - \sin(2z)/4]_0^{\pi/2} + \\
&\quad 2/\pi\ c_i \text{ for all } i = 2,n-1 \\
&= 1 + 2/\pi\ (c_i^2 - 1)\pi/4 + 2/\pi\ c_i \\
&\quad \text{for all } i = 2,n-1 \\
&= 1/2 + c_i^2/2 + 2/\pi\ c_i \text{ for all } i = 2,n-1
\end{aligned}$$

$$a_i=(2/(n(1+c_i^2+4/\pi c_i)))^{\frac{1}{2}} \tag{13}$$

for all $i=2,n-1$ where $$c_i=\tan(\pi(i-1)/(n-1)/2)$$

for all $i=2,n-1$ from equation (9).

Thus all the inner a's are determined. The remaining coefficients, $a_1$ and $a_n$, are found as follows using the known values for the inner a's. The normality condition, equation (4), requires that $$a_1^2 + a_n^2 = 1 - \sum_{i=2}^{n-1} a_i^2 \tag{14}$$

All values on the right-hand side of this equation are known from equation (13). Therefore let the known value of equation (14) be called B. The uniformity condition, equation (5), further requires that $$a_1 a_n = -1/2 \sum_{i=2}^{n-1} a_i a_{n-i+1} \tag{15}$$

All values on the right-hand side of this equation are also known from equation (13). Therefore let the known value of equation (15) be called C. This equation now simplifies to $$a_n=C/a_1 \tag{16}$$

Substituting this equation into equation (14) yields $$a_1^2+(C/a_1)^2=B$$

$$a_1^4-Ba_1^2+C^2=0$$

$$a_1^2=\tfrac{1}{2}(B+(B^2-4C^2)^{\frac{1}{2}})$$

Note that the positive root of $(B^2-4C^2)$ is chosen to make $a_1^2$, hence $a_1$, both positive and as large as possible. Thus $$a_1=(\tfrac{1}{2}(B+(B^2-4C^2)^{\frac{1}{2}}))^{\frac{1}{2}}$$

Finally, equation (16) can now be used to solve for $a_n$. Thus all a's are completely determined for any given n, and all the required conditions for optimality are satisfied.

The calculated coefficient values for n=3 to 8 are given below.

For n=3
$a_1=0.8849208857$
$a_2=0.4513001479$
$a_3=-0.1150791143$

For n=4
$a_1=0.8047485087$
$a_2=0.4916586598$
$a_3=0.2838592596$
$a_4=-0.1734229534$

For n=5
$a_1=0.7461727884$
$a_2=0.4852188414$
$a_3=0.3495755914$
$a_4=0.2009842248$
$a_5=-0.2125819679$

For n=6
$a_1=0.7006620866$
$a_2=0.4684048718$
$a_3=0.3686354401$
$a_4=0.2678293246$
$a_5=0.1521939687$
$a_6=-0.2426558830$

For n=7
$a_1=0.6634549638$
$a_2=0.4496773381$
$a_3=0.3716590125$
$a_4=0.2954452984$
$a_5=0.2145774309$
$a_6=0.1204906796$ $a_7 = -0.2676527210$
For n=8
$a_1 = 0.6317150534$
$a_2 = 0.4314991170$
$a_3 = 0.3680977089$
$a_4 = 0.3070700208$
$a_5 = 0.2448801701$
$a_6 = 0.1772665138$
$a_7 = 0.0984868577$
$a_8 = -0.2895985266$

Figure 3:
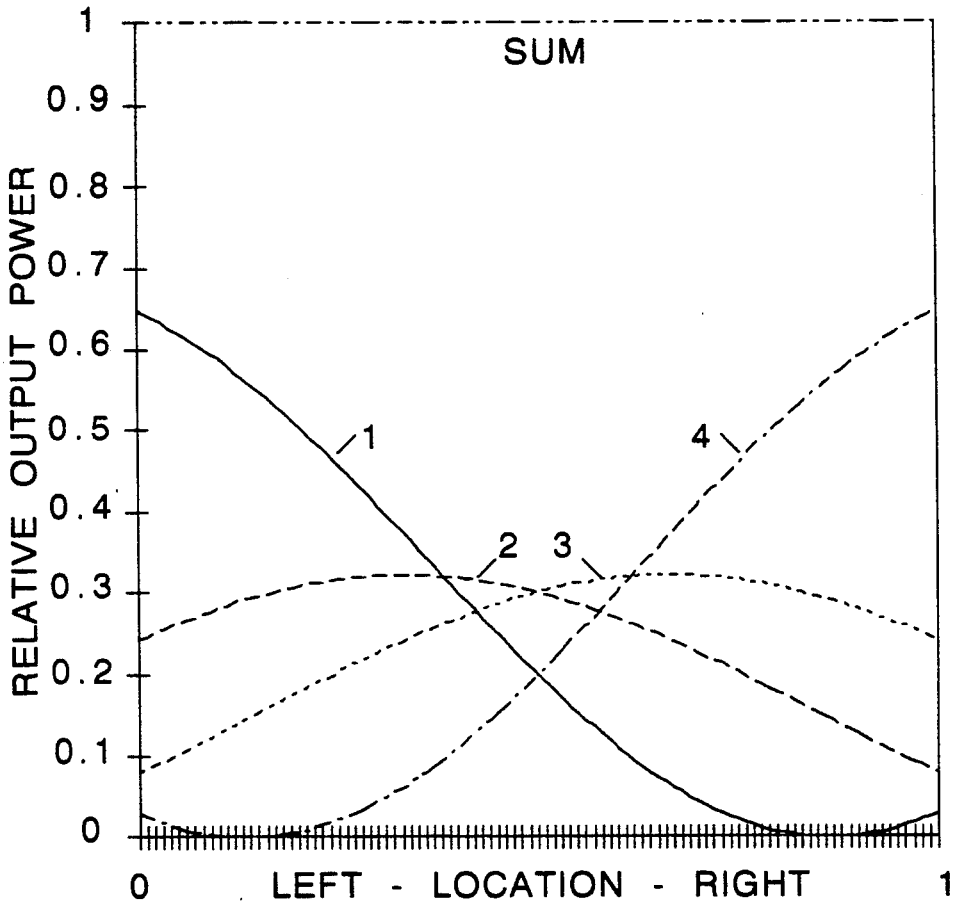
FIG. 3 shows the relative output power from each channel of a 4 channel optimal sonic separator of my invention plotted against mixed location. This Figure also shows that the summed relative output power from all channels is always 1.

FIG. 3 shows the relative output power from each channel of a 4 channel optimal sonic separator plotted against recording mix location, x. It also shows the summed output power from all channels, which is equal to 1 for all values of x. From this we see that both uniformity and normality are satisfied. In addition, it can be seen that the channel peaks are at 0, $\frac{1}{3}$, $\frac{2}{3}$, and 1, as required by the integrity condition. Satisfaction of the symmetry condition is seen in FIG. 3 as symmetry of the collection of outputs about the line $x=\frac{1}{2}$. That is, if FIG. 3 were folded about the line $x=\frac{1}{2}$, the output curves from the right half would overlay those from the left half.

Figure 4:
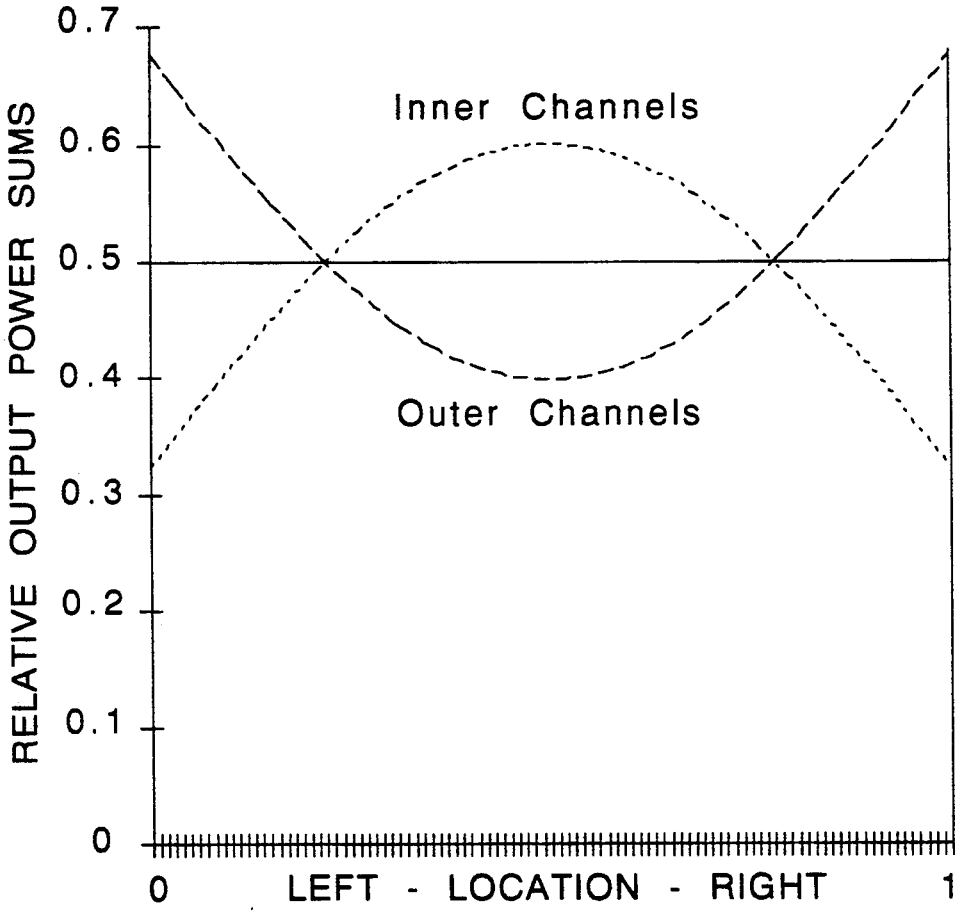
FIG. 4 shows the sums of the relative power outputs from symmetric pairs of channels for my 4 channel optimal sonic separator. This Figure illustrates the effect of the balance condition on the localization of mixed sounds.

FIG. 4 shows the results of satisfying the balance condition. The 2 curves plotted in FIG. 4 are the sums of the relative power outputs for symmetric pairs of channels (i and $n-i+1$) for a 4 channel optimal sonic separator. Note that the average sum for each pair is $\frac{1}{2}=2/n$, as required to satisfy the balance condition. The importance of this result is that sounds mixed near the center will be reproduced mostly from the inner loudspeakers, while sounds mixed near either the left or right side will come mostly from the outer loudspeakers, particularly from the side where they were mixed. Thus the sounds are concentrated in the area near where they were mixed in the recording. This, combined with the integrity condition, produces the separation of mixed sounds.

Note that if L and R were defined differently, the evaluation of the integral in equation (11) would yield slightly different results. The derivation procedure, however, would remain the same. For example, if L and R were defined as $$L=(1-x)^{\frac{1}{2}}$$

$$R=x^{\frac{1}{2}}$$

then equations (2) and (13) would become, respectively, $$y_i=a_i(1-x)^{\frac{1}{2}}+a_{n-i+1}x^{\frac{1}{2}}$$

for all i=1,n
and $$a_i=(2/n(1+c_i^2+\pi/2\ c_i))^{\frac{1}{2}}$$

for all i=2, n−1
These changes in derived equations would produce slightly different coefficients as follows:

For n=3
$a_1 = 0.8957905268$
$a_2 = 0.4320876275$
$a_3 = -0.1042094732$
For n=4
$a_1 = 0.8282442216$
$a_2 = 0.4376276897$
$a_3 = 0.3094495070$
$a_4 = -0.1635069335$
For n=5
$a_1 = 0.7799349654$
$a_2 = 0.4225551498$
$a_3 = 0.3346936371$
$a_4 = 0.2439623295$
$a_5 = -0.2039881030$
For n=6
$a_1 = 0.7429386720$
$a_2 = 0.4046827415$
$a_3 = 0.3361909709$
$a_4 = 0.2744987783$
$a_5 = 0.2023413708$
$a_6 = -0.2344312902$
For n=7
$a_1 = 0.7131966442$
$a_2 = 0.3875303849$
$a_3 = 0.3308154382$
$a_4 = 0.2828677514$
$a_5 = 0.2339218397$
$a_6 = 0.1733088568$
$a_7 = -0.2587708282$
For n=8
$a_1 = 0.6884009420$
$a_2 = 0.3718585809$
$a_3 = 0.3231893372$
$a_4 = 0.2835080577$
$a_5 = 0.2455251802$
$a_6 = 0.2044028842$
$a_7 = 0.1518106300$
$a_8 = -0.2790834139$

PREFERRED EMBODIMENTS OF THE INVENTION

Figure 5:
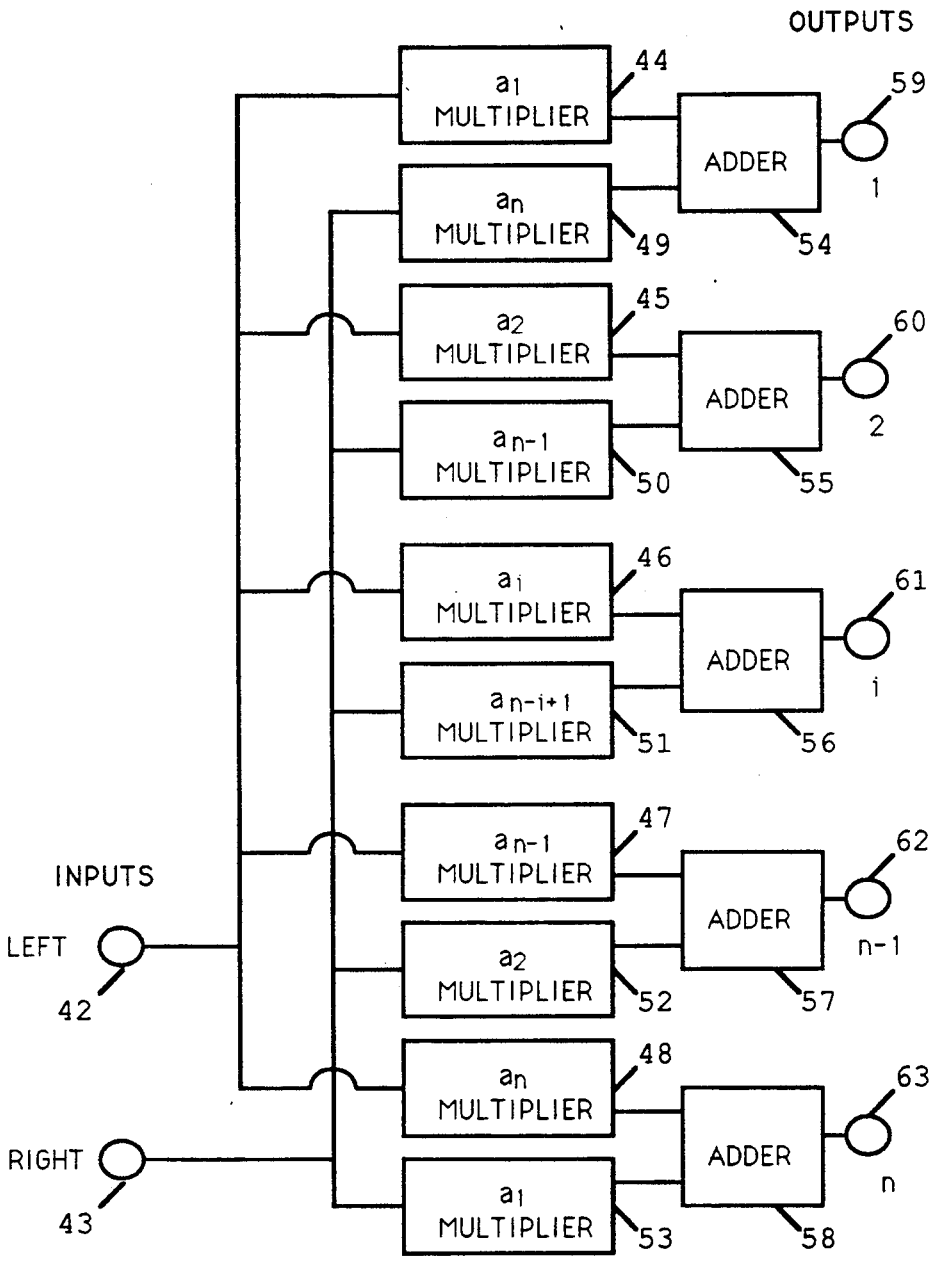
FIG. 5 shows a block diagram of a preferred embodiment of the invention.

FIG. 5 shows a block diagram of a preferred embodiment of the invention which performs the required processing for an n-channel optimal sonic separator. Please note that my invention is not limited to any specific number of channels.

In the circuit of FIG. 5, multipliers 44, 45, 46, 47, and 48 are connected in parallel to the left input 42. These multiply the left input signal by $a_1, a_2, \ldots, a_n$, respectively. Multipliers 49, 50, 51, 52, and 53 are connected in parallel to the right input 43. These multiply the right input signal by $a_n, a_{n-1}, \ldots, a_1$, respectively. The outputs from multipliers 44 and 49 are added by adder 54 to produce the first output signal at 59. The outputs from multipliers 45 and 50 are added by adder 55 to produce the second output signal at 60. The outputs from multipliers 46 and 51 are added by adder 56 to produce the i-th output signal at 61. This inner channel is replicated as many times as required to provide n channels. Appropriate values of $a_i$ and $a_{n-i+1}$ are used by the multipliers in each replicated channel. The outputs from multipliers 47 and 52 are added by adder 57 to produce the (n−1)-th output signal at 62. The outputs from multipliers 48 and 53 are added by adder 58 to produce the n-th output signal at 63.

Because multiplication by a number is equivalent to division by the reciprocal of that number, any or all of the multipliers in this circuit could be replaced by a corresponding divider. Similarly, because addition of a number is equivalent to subtraction of the negative of that number, any or all of the adders in this circuit could be replaced by a corresponding differencer if one of the preceding multipliers were also an inverter. The adders and multipliers associated with any of the outputs could therefore be combined in many different forms to produce the desired linear combinations of inputs.

Analog implementations of the invention may require slightly different circuitry for the inner and outer channels. This is a result of the fact that only the outer channels use $a_n$, which is the only coefficient less than 0. FIGS. 6 through 9 illustrate several alternative analog embodiments of an outer channel. Similarly, FIGS. 10 through 13 illustrate several alternative analog embodiments of an inner channel. All these Figures for both the inner and outer channels are specific examples of possible implementations of the individual channels in FIG. 5. An n-channel optimal sonic separator consists of any 2 outer channel circuits effectively connected in parallel with $n-2$ inner channel circuits. Component values and multiplying factors are chosen for each output channel consistent with the optimal coefficients $a_i$.

Figure 6:
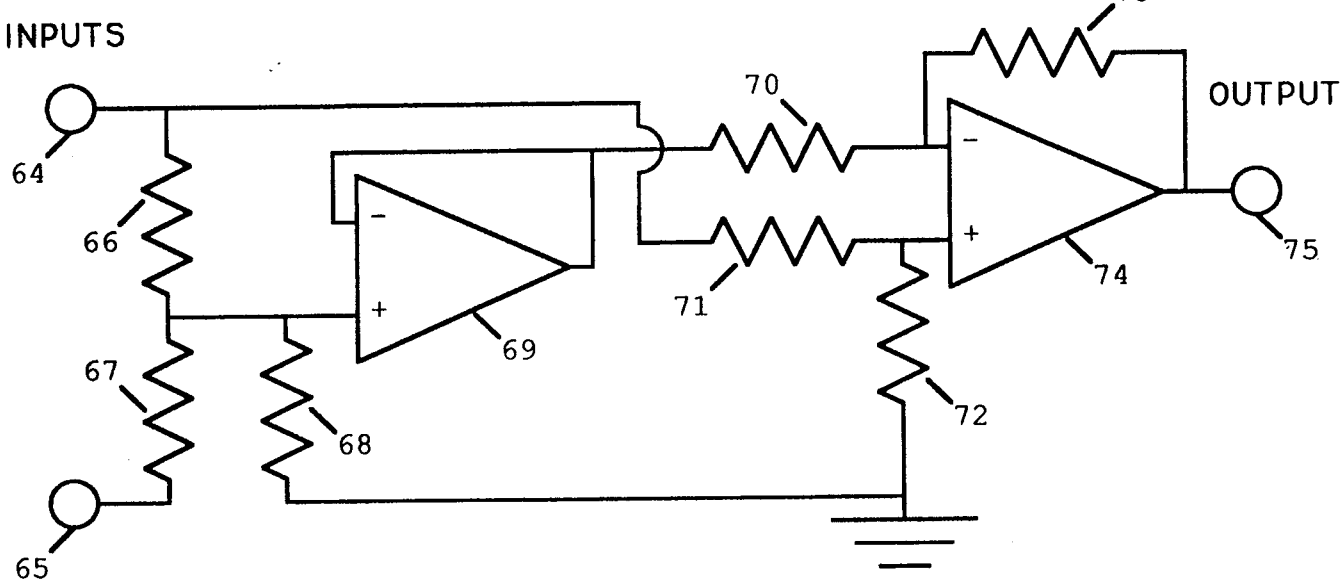
FIG. 6 a preferred embodiment of an outer channel of the invention.

In FIG. 6, resistances 66, 67, and 68 are chosen such that for voltages V and W at inputs 64 and 65, respectively, the voltage at the output of operational amplifier 69 is $(1-a_1)V-a_nW$. If resistance 66 is r, then resistance 67 is $r(a_1-1)/a_n$ and resistance 68 is $r(1-a_1)/(a_1+a_n)$. Resistances 70, 71, 72, and 73 are of one value. Thus the output at 75 of operational amplifier 74 is $V-((1-a_1)V-a_nW)=a_1V+a_nW$, as desired.

Figure 7:
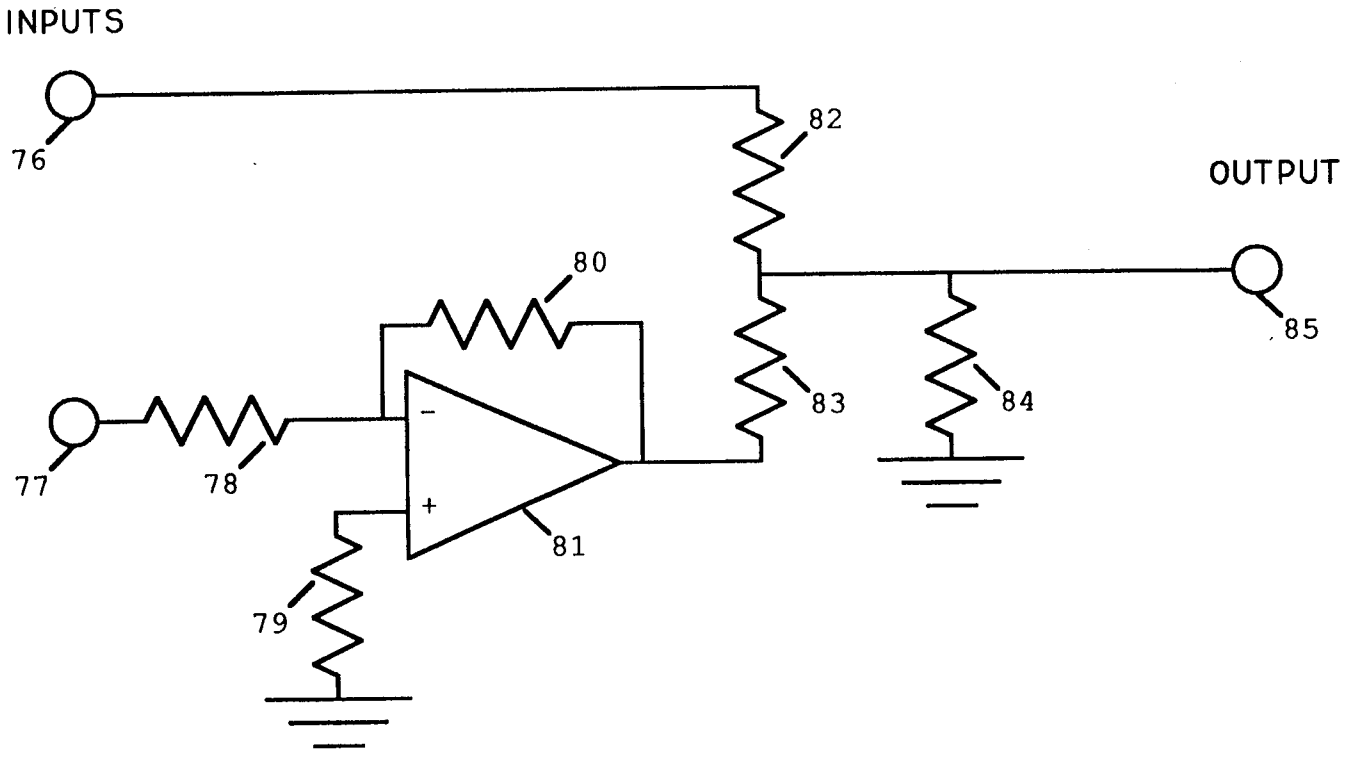
FIG. 7 shows an alternative preferred embodiment of an outer channel of the invention.

In FIG. 7, resistances 78 and 80 are of one value and resistance 79 is half that value so that for a voltage W at input 77, the output of operational amplifier 81 is $-W$. If resistance 84 is r, then resistance 82 is $r(1-a_1+a_n)/a_1$ and resistance 83 is $r(1-a_1+a_n)/(-a_n)$, so that for a voltage V at input 76, the output at 85 is $a_1V+a_nW$, as desired.

Figure 8:
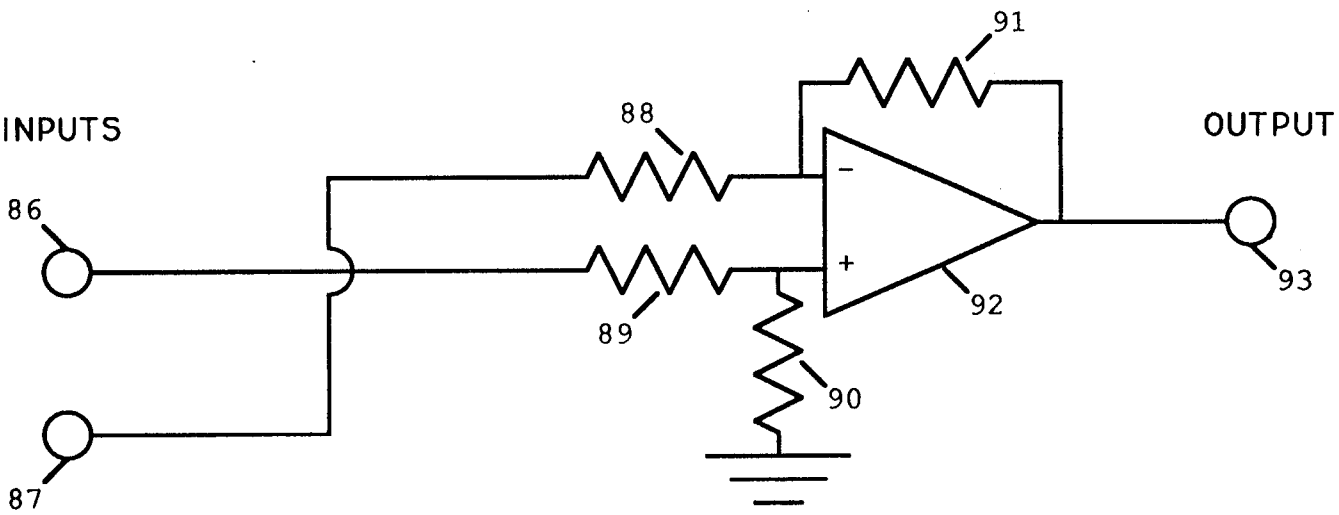
FIG. 8 shows another alternative preferred embodiment of an outer channel of the invention.

In FIG. 8, if resistance 91 is r, then resistance 88 is $r/(-a_n)$, resistance 89 is $r/a_1$, and resistance 90 is $r/(1-a_1-a_n)$, so that for voltages V and W at inputs 86 and 87, respectively, the output at 93 of operational amplifier 92 is $a_1V+a_nW$, as desired.

Figure 9:
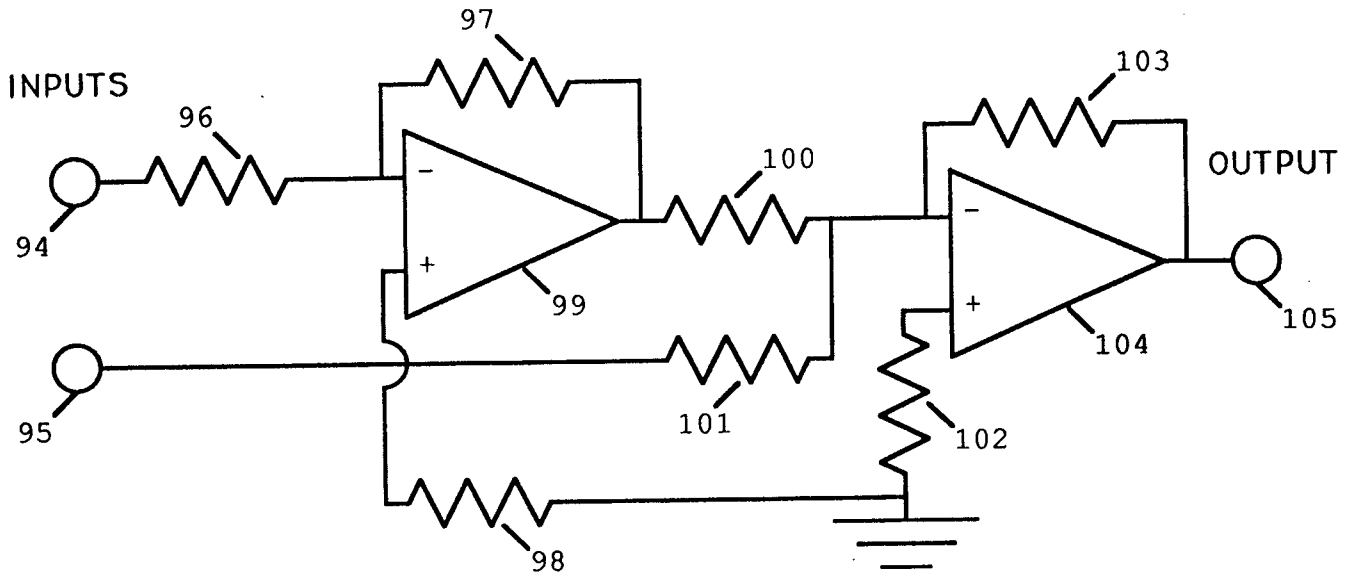
FIG. 9 shows yet another alternative preferred embodiment of an outer channel of the invention.

In FIG. 9, resistances 96 and 97 are of one value, and resistance 98 is half that value so that for a voltage V at input 94, the output of operational amplifier 99 is $-V$. If resistance 103 is r, then resistance 101 is $r/(-a_n)$, resistance 100 is $r/a_1$, and resistance 102 is $r/(1+a_1-a_n)$, so that for a voltage W at input 95, the output at 105 of operational amplifier 104 is $a_1V+a_nW$, as desired.

Figure 10:
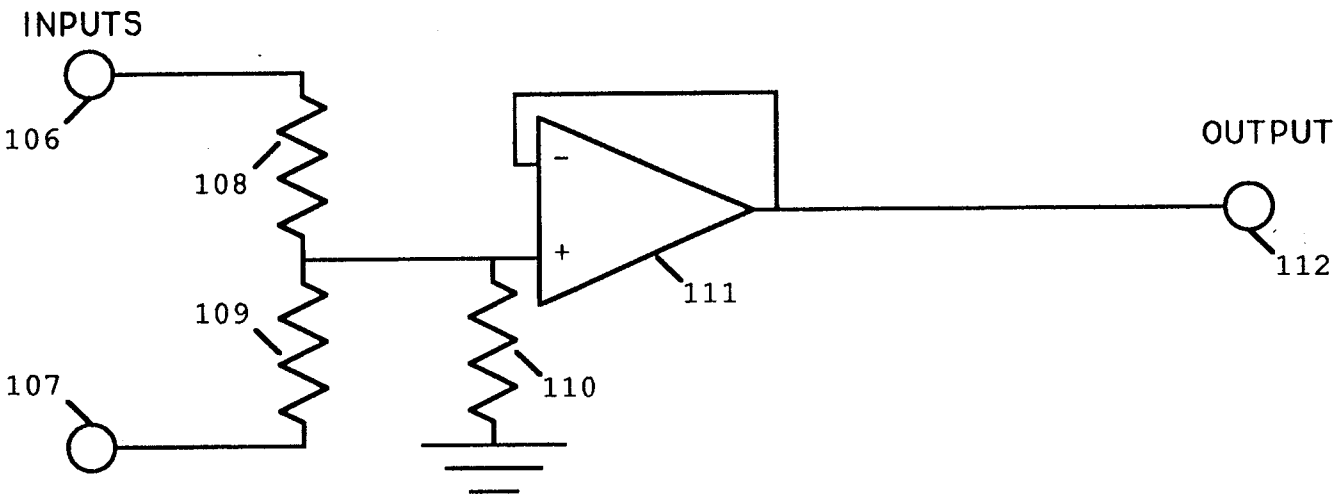
FIG. 10 shows a preferred embodiment of an inner channel of the invention.

In FIG. 10, if resistance 110 is r, then resistance 108 is $r(1-a_i-a_{n-i+1})/a_i$ and resistance 109 is $r(1-a_i-a_{n-i+1})/a_{n-i+1}$, so that for voltages V and W at inputs 106 and 107, respectively, the output at 112 of operational amplifier 111 is $a_iV+a_{n-i+1}W$, as desired.

Figure 11:
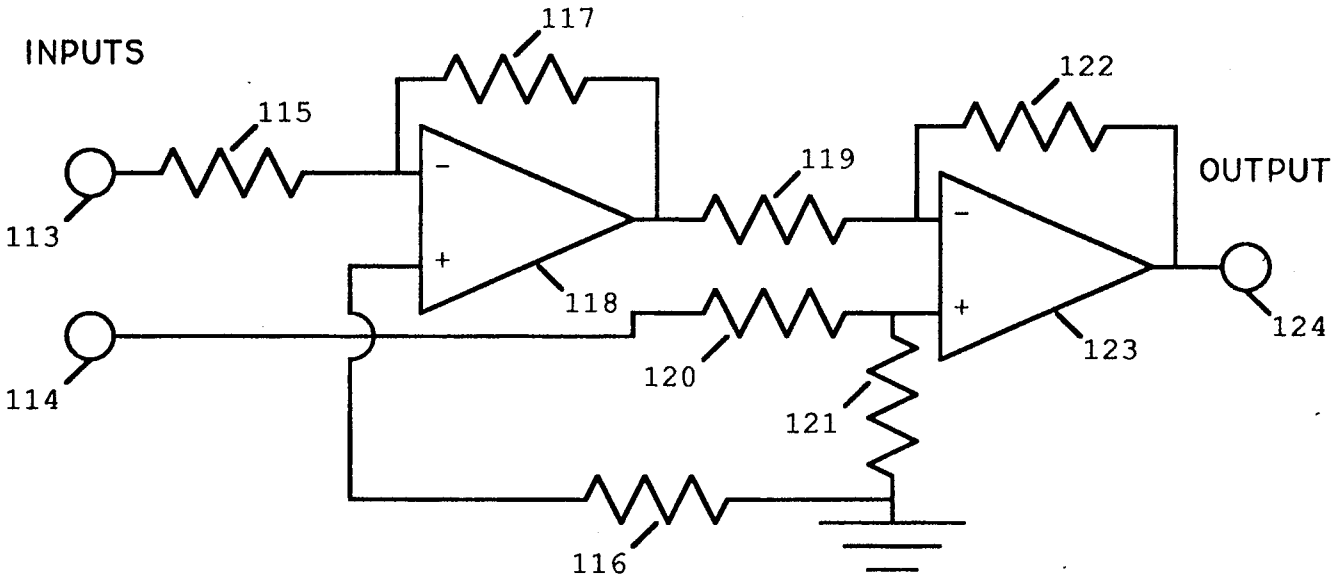
FIG. 11 shows an alternative preferred embodiment of an inner channel of the invention.

In FIG. 11, resistances 115 and 117 are of one value and resistance 116 is half that value so that for a voltage V at input 113, the output of operational amplifier 118 is $-V$. If resistance 122 is r, then resistance 119 is $r/a_i$, resistance 120 is $r/a_{n-i+1}$, and resistance 121 is $r/(1+a_i-a_{n-i+1})$, so that for a voltage W at input 114, the output at 124 of operational amplifier 123 is $a_iV+a_{n-i+1}W$, as desired.

Figure 12:
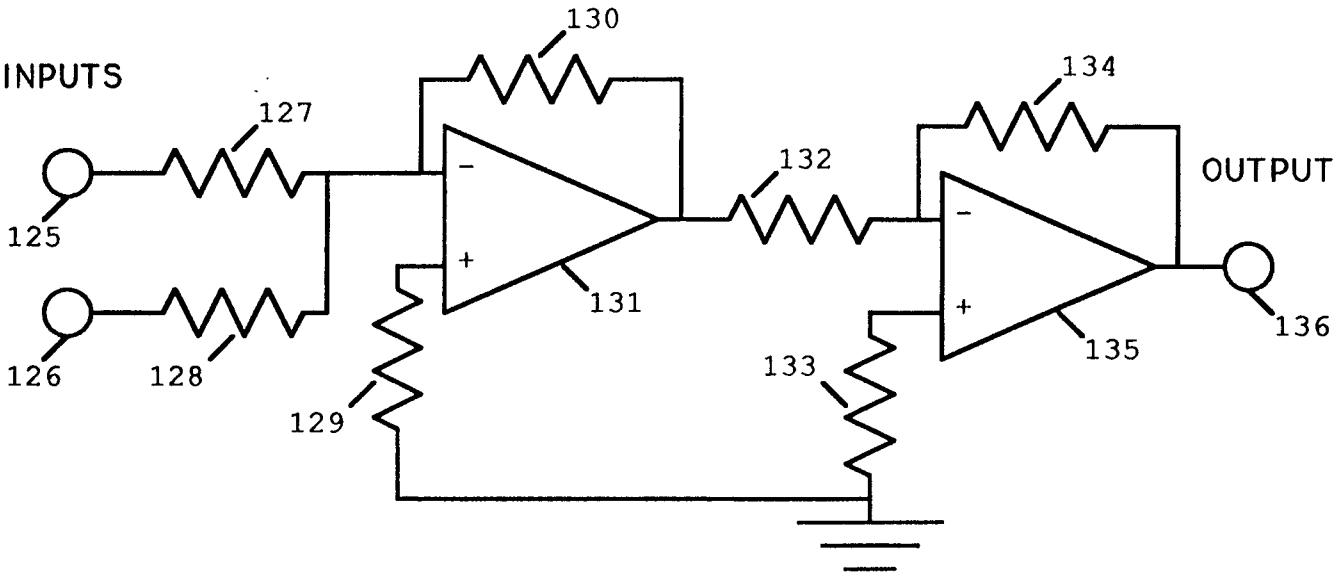
FIG. 12 shows another alternative preferred embodiment of an inner channel of the invention.

In FIG. 12, if resistance 130 is r, then resistance 127 is $r/a_i$, resistance 128 is $r/a_{n-i+1}$, and resistance 129 is $r/(1+a_i+a_{n-i+1})$, so that for voltages V and W at inputs 125 and 126, respectively, the output of operational amplifier 131 is $-a_iV-a_{n-i+1}W$. Resistances 132 and 134 are of one value and resistance 133 is half that value, so that the output at 136 of operational amplifier 135 is $a_iV+a_{n-i+1}W$, as desired.

Figure 13:
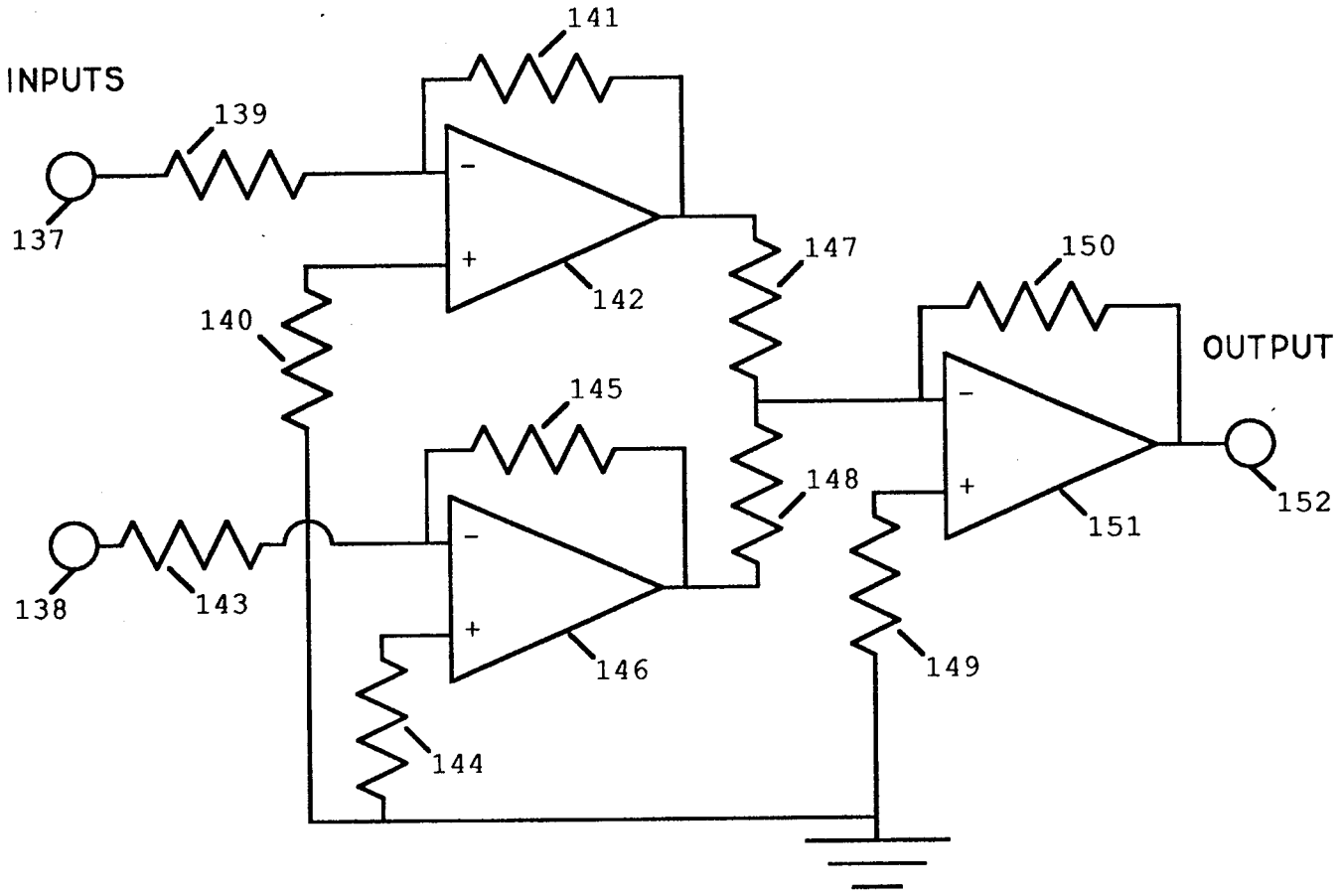
FIG. 13 shows yet another alternative preferred embodiment of an inner channel of the invention.

In FIG. 13, the resistances 139 and 141 are of one value and the resistance 140 is half that value, so that for a voltage V at input 137, the output of operational amplifier 142 is $-V$. The resistances 145 and 143 are also of one value, and the resistance 144 is half that value, so that for a voltage W at input 138, the output of operational amplifier 146 is $-W$. If resistance 150 is r, then resistance 147 is $r/a_i$, resistance 148 is $r/(a_{n-i+1})$, and resistance 149 is $r/(1+a_i+a_{n-i+1})$, so that the output at 152 from operational amplifier 151 is $a_iV+a_{n-i+1}W$, as desired.

The resistance values given for FIGS. 6 through 13 are examples. Other values which will also work will be obvious to those knowledgeable in the art, and are considered within the scope of the invention. Though the circuits shown in these Figures use analog technology, equivalent digital circuits could also easily be built by those skilled in the art.

The scope of this invention includes both analog and digital implementations. For use with analog sound reproduction systems, a digital implementation of this invention would require analog-to-digital and digital-to-analog converters to interface with the analog system. Since these are not always required, however, they are not shown in the Figures. In addition to the various embodiments shown here, input, output, and internal buffers could be added wherever needed to provide isolation and stability of performance. In addition, inverters or non-frequency-dependent phase shifters could be added at either or both ends of the illustrated circuits without affecting substantially the design. This invention is intended to include all similar circuits as well as others which may produce outputs proportional to those of the optimal sonic separator.

The uniqueness of this invention, however, lies not in device design or circuit topology, but rather in the concept and process of separating mixed audio signals according to mixed location, and in the formulation and solution of the conditions of optimality. There are many uses of this technology. It could be used in a recording studio to monitor the recording when making the mixdown. It could be used to reproduce both recorded and live stereo information. It could be used in theaters to enhance the forward image after appropriate surround sound decoding. Using additional sets of stereo track pairs, appropriately mixed with side and rear sounds, this device could be used to improve the sonic image at the sides and rear of the listener as well as in front.

It is to be understood that additional embodiments and uses of this invention will be obvious to those skilled in the art. The embodiments described herein together with those additional embodiments and uses are considered to be within the scope of the invention.

Figure 14A:
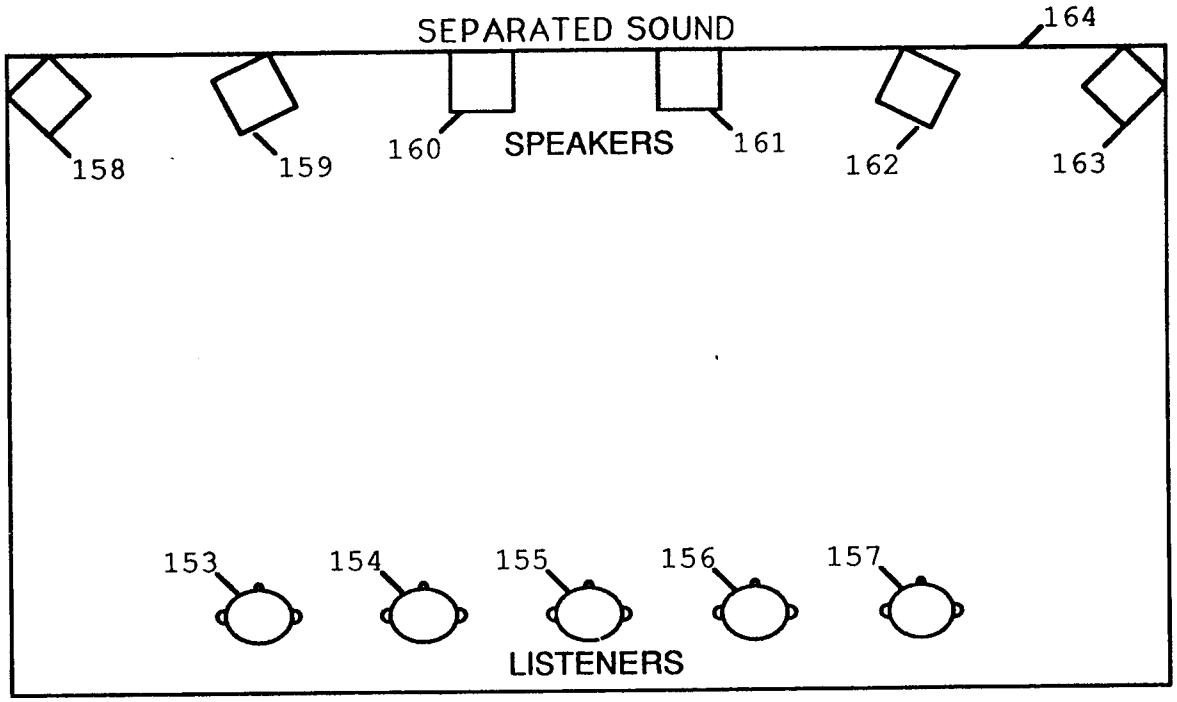
FIG. 14A shows one way to set up and use my separated sound system to produce a realistic sound field.
Figure 14B:
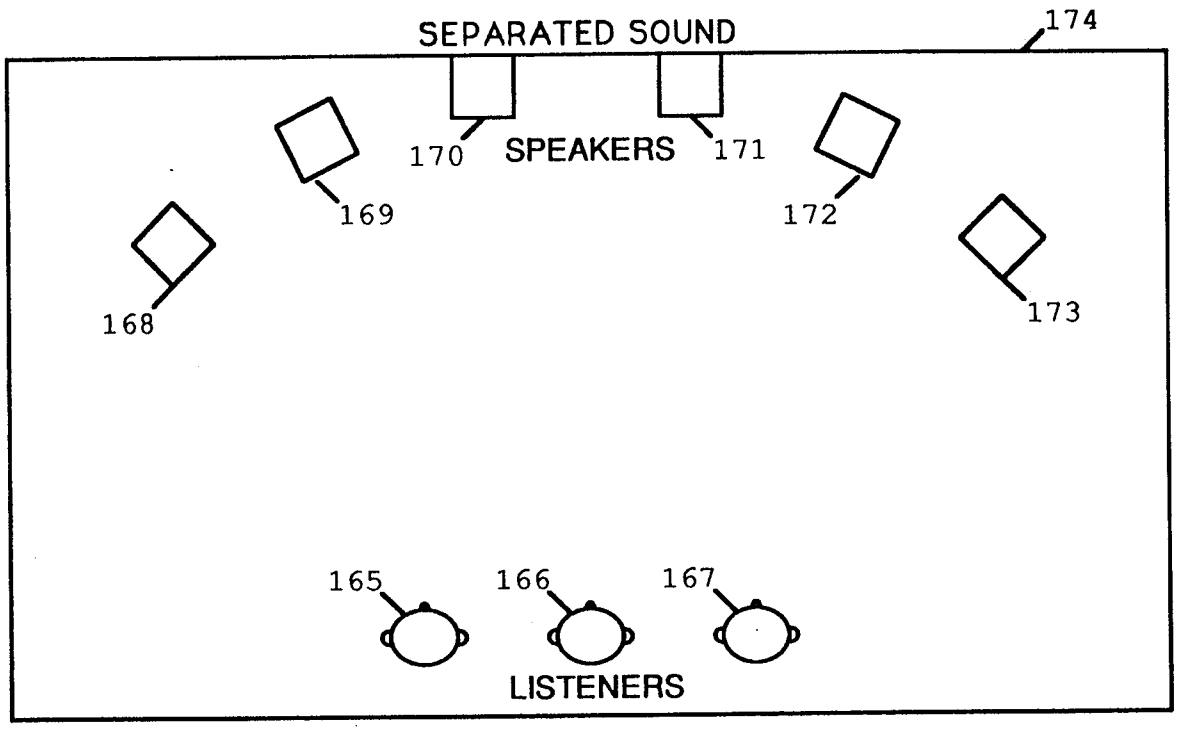
FIG. 14B shows an alternative way to set up and use my separated sound system to produce a realistic sound field.

FIGS. 14A and 14B illustrate 2 ways to set up and use my separated sound system to produce a realistic sound field. The cases illustrated are for a 6 loudspeaker system. In FIG. 14A the loudspeakers 158, 159, 160, 161, 162, and 163 are arranged along the longest wall of the listening room 164 with the listeners 153, 154, 155, 156, and 157 near the opposite wall. In FIG. 14B the loudspeakers 168, 169, 170, 171, 172, and 173 are arranged in a listening room 174 in an arc equidistant from the central listening location 166. In both cases the loudspeakers are evenly spaced to produce the maximum separation between loudspeakers. Also, the angle between the left-most and right-most loudspeakers as viewed from the central listening location is about 90 degrees. In either case, the location of the loudspeakers and listeners is not critical. The 2 cases illustrated represent extremes of loudspeaker and listener placement, and any case between these extremes will work well. An advantage of the arc pattern is that the volume of each loudspeaker is the same at the central listening location. This balance is lost however for other listeners 165 and 167. Advantages of the straight arrangement are that the range of listening locations is more spread out and the system fits better into rectangular rooms. In either case, the loudspeakers, if they are directional, should be pointed toward the central listening location. This will provide improved balance in both cases. All the above arrangement suggestions hold true for any number of loudspeakers used with the optimal sonic separator.

I have personally built, tested and independently verified my optimal sonic separator. The results are quite remarkable when compared with regular stereo. The forward image and apparent definition of the various instruments and voices is surprisingly lifelike. Listening from anywhere in front of the loudspeakers is like listening to the live performance from different locations in the concert hall. In fact, the difference between separated sound and stereo is more striking than between stereo and mono.

What I claim is:

1. An improved forward sound imaging system, comprising:

first and second inputs for receiving left and right channel audio input signals of a stereophonic system;

a plurality of n, n being any whole number greater than three, output channels for connection to n loudspeakers spaced symmetrically left to right and forward of a listening position; and a plurality of n independent means, each responsive to said left and right audio input signals for developing a first through n-th audio output signal proportional to a sum of a product of a first through n-th coefficient and the left audio input signal and a product of the n-th through first coefficient and the right audio input signal, in a first through n-th one of the output channels, respectively; and wherein:

1 is greater than the first coefficient;

each of the second through (n−1-th coefficients is less than the first through (n−2)-th coefficient, respectively;

the (n−1)-th coefficient is greater than 0; and the n-th coefficient is less than 0 and greater than the negative of the first coefficient.

2. The system of claim 1, wherein:

n is less than 9; and for n=4 the first coefficient is between 0.80 and 0.83,
the second coefficient is between 0.43 and 0.50,
the third coefficient is between 0.28 and 0.31, and
the fourth coefficient is between −0.18 and −0.16, for n=5 the first coefficient is between 0.74 and 0.78,
the second coefficient is between 0.42 and 0.49,
the third coefficient is between 0.33 and 0.35,
the fourth coefficient is between 0.20 and 0.25, and
the fifth coefficient is between −0.22 and −0.20, for n=6 the first coefficient is between 0.70 and 0.75,
the second coefficient is between 0.40 and 0.47,
the third coefficient is between 0.33 and 0.37.
the fourth coefficient is between 0.26 and 0.28,
the fifth coefficient is between 0.15 and 0.21, and
the sixth coefficient is between −0.25 and −0.23, for n=7 the first coefficient is between 0.66 and 0.72,
the second coefficient is between 0.38 and 0.45,
the third coefficient is between 0.33 and 0.38,
the fourth coefficient is between 0.28 and 0.30,
the fifth coefficient is between 0.21 and 0.24,
the sixth coefficient is between 0.12 and 0.18, and
the seventh coefficient is between −0.27 and −0.25, for n=8 the first coefficient is between 0.63 and 0.69,
the second coefficient is between 0.37 and 0.44,
the third coefficient is between 0.32 and 0.37,
the fourth coefficient is between 0.28 and 0.31,
the fifth coefficient is between 0.24 and 0.25,
the sixth coefficient is between 0.17 and 0.21,
the seventh coefficient is between 0.09 and 0.16, and
the eighth coefficient is between −0.29 and −0.27.

3. The system of claim 1, wherein:

n is less than 9;and for n=4 the first coefficient is within 0.01 of 0.80,
the second coefficient is within 0.01 of 0.49,
the third coefficient is within 0.01 of 0.28, and
the fourth coefficient is within 0.01 of −0.17, for n=5 the first coefficient is within 0.01 of 0.75,
the second coefficient is within 0.01 of 0.49,
the third coefficient is within 0.01 of 0.35,
the fourth coefficient is within 0.01 of 0.20, and
the fifth coefficient is within 0.01 of −0.21, for n=6 the first coefficient is within 0.01 of 0.70,
the second coefficient is within 0.01 of 0.47,
the third coefficient is within 0.01 of 0.37,
the fourth coefficient is within 0.01 of 0.27,
the fifth coefficient is within 0.01 of 0.15, and
the sixth coefficient is within 0.01 of −0.24, for n=7 the first coefficient is within 0.01 of 0.66,
the second coefficient is within 0.01 of 0.45,
the third coefficient is within 0.01 of 0.37,
the fourth coefficient is within 0.01 of 0.30,
the fifth coefficient is within 0.01 of 0.21,
the sixth coefficient is within 0.01 of 0.12, and
the seventh coefficient is within 0.01 of −0.27, for n=8 the first coefficient is within 0.01 of 0.63,
the second coefficient is within 0.01 of 0.43,
the third coefficient is within 0.01 of 0.37,
the fourth coefficient is within 0.01 of 0.31,
the fifth coefficient is within 0.01 of 0.24,
the sixth coefficient is within 0.01 of 0.18,
the seventh coefficient is within 0.01 of 0.10, and
the eighth coefficient is within 0.01 of −0.29.

4. The system of claim 1, wherein n=4.
5. The system of claim 2, wherein n=4.
6. The system of claim 3, wherein n=4.
7. The system of claim 1, wherein n=5.
8. The system of claim 2, wherein n=5.
9. The system of claim 3, wherein n=5.
10. The system of claim 1, wherein n=6.
11. The system of claim 2, wherein n=6.
12. The system of claim 3, wherein n=6.
13. The system of claim 1, wherein n=7.
14. The system of claim 2, wherein n=7.
15. The system of claim 3, wherein n=7.
16. The system of claim 1, wherein n=8.
17. The system of claim 2, wherein n=8.
18. The system of claim 3, wherein n=8.

19. An improved forward sound imaging system, comprising:

first and second inputs for receiving left and right channel audio input signals of a stereophonic system;

a plurality of three output channels for connection to three loudspeakers spaced symmetrically left to right and forward of a listening position; and a plurality of three independent means, each responsive to said left and right audio input signals for developing a first through third audio output signal proportional to a sum of a product of a first through third coefficient and the left audio input signal and a product of the third through first coefficient and the right audio input signal, in a first through third one of the output channels, respectively; and wherein:

1 is greater than the first coefficient the second coefficient is less than the first coefficient and greater than 0; and the third coefficient is less than 0 and greater than the negative of the first coefficient.

20. An improved forward sound imaging system comprising:

first and second inputs for receiving left and right channel audio input signals of a stereophonic system;

a plurality of three output channels for connection to three loudspeakers spaced symmetrically left to right and forward of a listening position; and a plurality of three independent means, each responsive to said left and right audio input signals for developing a first through third audio output signal proportional to a sum of a product of a first through third coefficient and the left audio input signal and a product of the third through first coefficient and the right audio input signal, in a first through third one of the output channels, respectively; and wherein:

the first coefficient is between 0.88 and 0.90, the second coefficient is between 0.43 and 0.46, and the third coefficient is between −0.12 and −0.10.

21. An improved forward sound imaging system, comprising:

first and second inputs for receiving left and right channel audio input signals of a stereophonic system;

a plurality of three output channels for connection to three loudspeakers spaced symmetrically left to right and forward of a listening position; and a plurality of three independent means, each responsive to said left and right audio input signals for developing a first through third audio output signal proportional to a sum of a product of a first through third coefficient and the left audio input signal and a product of the third through first coefficient and the right audio input signal, in a first through third one of the output channels, respectively; and wherein:

the first coefficient is within 0.01 of 0.88, the second coefficient is within 0.01 of 0.45, and the third coefficient is within 0.01 of −0.12.

* * * * *